United States Patent [19]

Beaudoin et al.

[11] 4,353,143

[45] Oct. 12, 1982

[54] SWEEPING APPARATUS

[76] Inventors: Joseph L. Y. Beaudoin, 1026 Willowdale Ave., Willowdale, Ontario, Canada, M3M 3E1; Joseph F. Y. Beaudoin, 61 Madawaska Ave., Toronto, Ontario, Canada, M2M 2R2

[21] Appl. No.: 197,220

[22] Filed: Oct. 15, 1980

[51] Int. Cl.[3] ..... A46B 3/18

[52] U.S. Cl. ..... 15/162; 15/104.2

[58] Field of Search ..... 15/162, 163, 164, 165, 15/242, 243, 249, 104.16, 104.2, 104.3 SN

[56] References Cited

U.S. PATENT DOCUMENTS

| | | | |
|---|---|---|---|
| 328,967 | 10/1885 | Delschleger | 15/162 |
| 901,483 | 10/1908 | Sandstrom | 15/104.2 |
| 1,545,355 | 7/1925 | Roth | 15/243 |
| 1,837,931 | 12/1931 | Walbrohl | 15/162 |
| 1,844,433 | 2/1932 | Markowitz | 15/104.3 SN |
| 1,964,057 | 6/1934 | Hill | 15/162 X |
| 2,219,555 | 10/1940 | Burwell | 15/162 |
| 2,536,185 | 1/1951 | Johnson | 15/163 X |
| 3,588,938 | 6/1971 | Guerrini | 15/105.3 SN |

FOREIGN PATENT DOCUMENTS

| | | | |
|---|---|---|---|
| 341979 | 10/1921 | Fed. Rep. of Germany | 15/243 |

*Primary Examiner*—Peter Feldman

[57] ABSTRACT

A conduit cleaning apparatus suited for manually cleaning elongated pipes, with particular reference to chimneys, has a unitary flexible pushing member of spring steel having a predetermined rectangular cross section providing sufficient stiffness to operate a brush within a chimney, including the transfer of thrust through a significant angle of curvature, while permitting elastic deformation of the pushing member so as to traverse sharp corners encountered in certain clean outs, and also for close coiling within a carrying frame. The brush, which is detachably mounted on an attachment adaptor secured to one end of the pushing member has a plurality of stiff tines deflectably mounted on spring means to permit a significant degree of coning of the brush in either direction during insertion or withdrawal past an obstruction. The arrangement permits the use of brushes of shaped planform, to accord with the cross-sectional shape of the conduit being cleaned. A clamping handle through which the pushing member is inserted permits the ready application of pushing or pulling effort to the pushing member.

7 Claims, 11 Drawing Figures

FIG. 4.
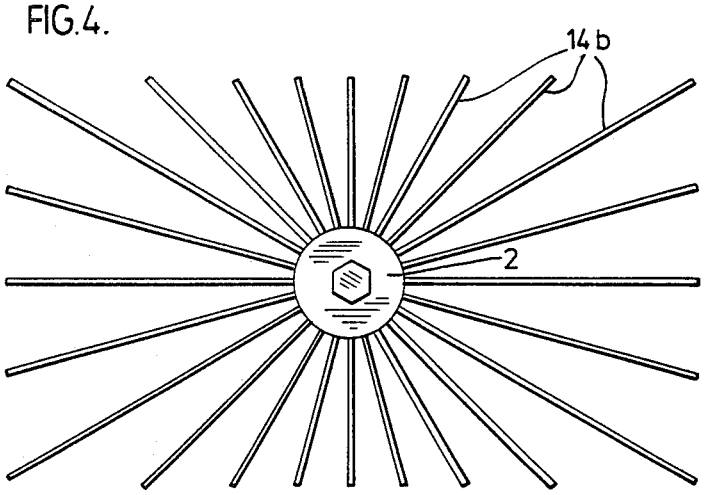
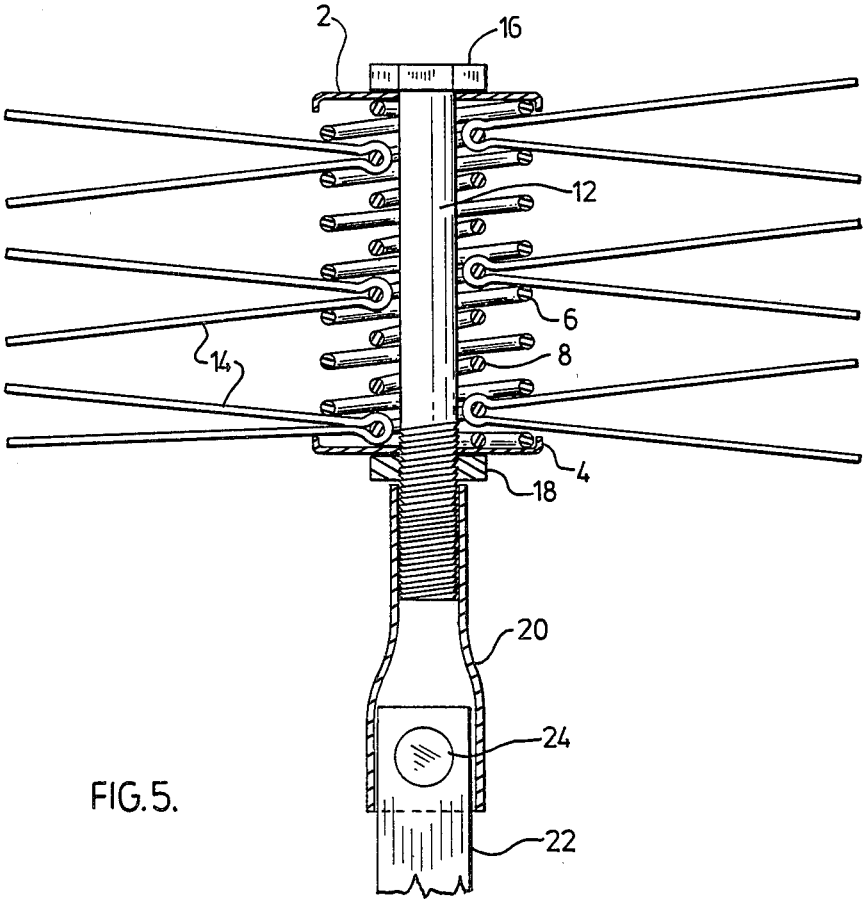
FIG. 5.

SWEEPING APPARATUS

BACKGROUND OF THE INVENTION

This invention is directed to a cleaning device, and in particular to a conduit brushing device for cleaning elongated conduits such as chimneys.

The use of fossil fuels such as wood and coal, particularly in a domestic context, has received tremendous impetus, due to the alleged scarcity of oil and gas, and also to the spiralling costs of such fluid fuels. An inevitable corollary to this has been an increase in the number of chimney fires, due to the manner in which creosote-like deposits can build up in pipes and chimneys, particularly with the burning of unsuitable or partially dried wood.

Conduit cleaning devices are very well known, in a highly developed art, ranging from the commonly used heavy weight suspended on a rope and having various brushing media attached thereto, for lowering from the roof down through a chimney being cleaned, including the rodded type of arrangement using bamboo or other flexible rods in about four foot lengths, having threaded joints for attachment of succeeding rods, and ranging to the use of electrically rotatable arrangements having a long flexible steel snake mounted on a drum and rotatably driven by a motor, normally used for the cleaning and clearance of drains.

Another known arrangement included a circular section spring steel rod coilable into about a four foot diameter coil, being highly unmanageable and creating significant fouling of the room of a house when used therein.

A wide variety of brushes are used, many using synthetic filaments of limited abrading capability.

OBJECTS OF THE INVENTION

An object of the invention is the provision of a lightweight chimney cleaning means of simpe, robust construction.

A further object of the invention is the provision of chimney cleaning means having interchangeable brush heads.

A further object of the invention is the provision of conduit cleaning means having a resiliently deformable self-centering brush.

A further object of the invention is the provision of a unitary pushing means having sufficient stiffness to operate a brush in entering and cleaning relation within a conduit such as a chimney.

A further object is the provision of a readily portable cleaning apparatus which may be easily handled and controlled in a comparatively small encompassing package to limit the spreading of soot or other matter.

SUMMARY OF THE INVENTION

The present invention provides a conduit cleaning apparatus having a unitary pushing means, brush attachment means secured to one end thereof, and a tined brush of predetermined planform resiliently mounted on a central spindle portion thereof to permit coning deformation of the brush for insertion of the brush past a restriction, the pushing means having predetermined stiffness to facilitate controlled coiling of the pushing means for transportation thereof, and permitting the negotiation of the brush around corners of limited radius. The tined brush is removeably attached by a central threaded spindle to the brush attachment means, and is of circular, square or rectangular planform. A manually operable clamping handle means is mounted in sliding relation upon the unitary pushing means, the handle means having detent means to grip the pushing means in secured relation to the handle, on grasping of a pair of handle portions of the handle means in gripping relation. The subject arrangement includes a storage and carrying rack having a pair of lightweight arms in cruciform arrangement, with angled portions extending from the ends thereof to form a discontinuous channel wherein the cleaning apparatus may be readily coiled, and providing a readily hand carried assembly.

The brush arrangement is provided with a central spindle having an inner spring mounted thereon upon which is mounted a plurality of tines comprising bifurcated stiff wires in hairpin-like formation, the bight portion thereof engaging over the wire of the inner spring, the arms of the tines extending radially outwardly from the inner spring, being arranged in axially spaced relation to extend between adjacent coil portions of an outer spring mounted in co-axial relation with the inner spring and secured to the spindle by end fastening means.

In use, upon the application of a deforming axial load against the tines, the tines collectively exert a levering movement against the two springs, in mutually opposing directions, permitting a significant extent of coning of the brush, so that a brush having a nominal diameter of 8" can cone down to about a 4" span, so as to negotiate a sharp bend in a clearout, or to enter past the open damper in a chimney. Upon removal of the restraining force occasioned by the obstruction to its passage, the brush then returns to its normal open arrangement, to bring the tines into resilient scraping relation with the inner surface of the conduit, normally the interior of a chimney tile.

The respective stiffnesses of the unitary pushing means, the brush tines and the brush springs are relatively selected to provide a pushing means capable of applying significant pushing and pulling forces around curves of quite limited radius of arc, and to apply axial force against the brush tines in loading relation with the brush springs to effectively deform the brush into penetrating coning relation for penetration inwardly or outwardly past restrictive obstacles.

DESCRIPTION OF THE DRAWINGS

Certain embodiments are described, reference being made to the accompanying drawings, wherein;

FIGS. 2,3 and 4 are planform showings of a circular, square and a rectangular form of brush;

FIG. 5 is a diametrical section of the brush and brush attachment means;

DESCRIPTION OF THE EMBODIMENTS

Figure 1:
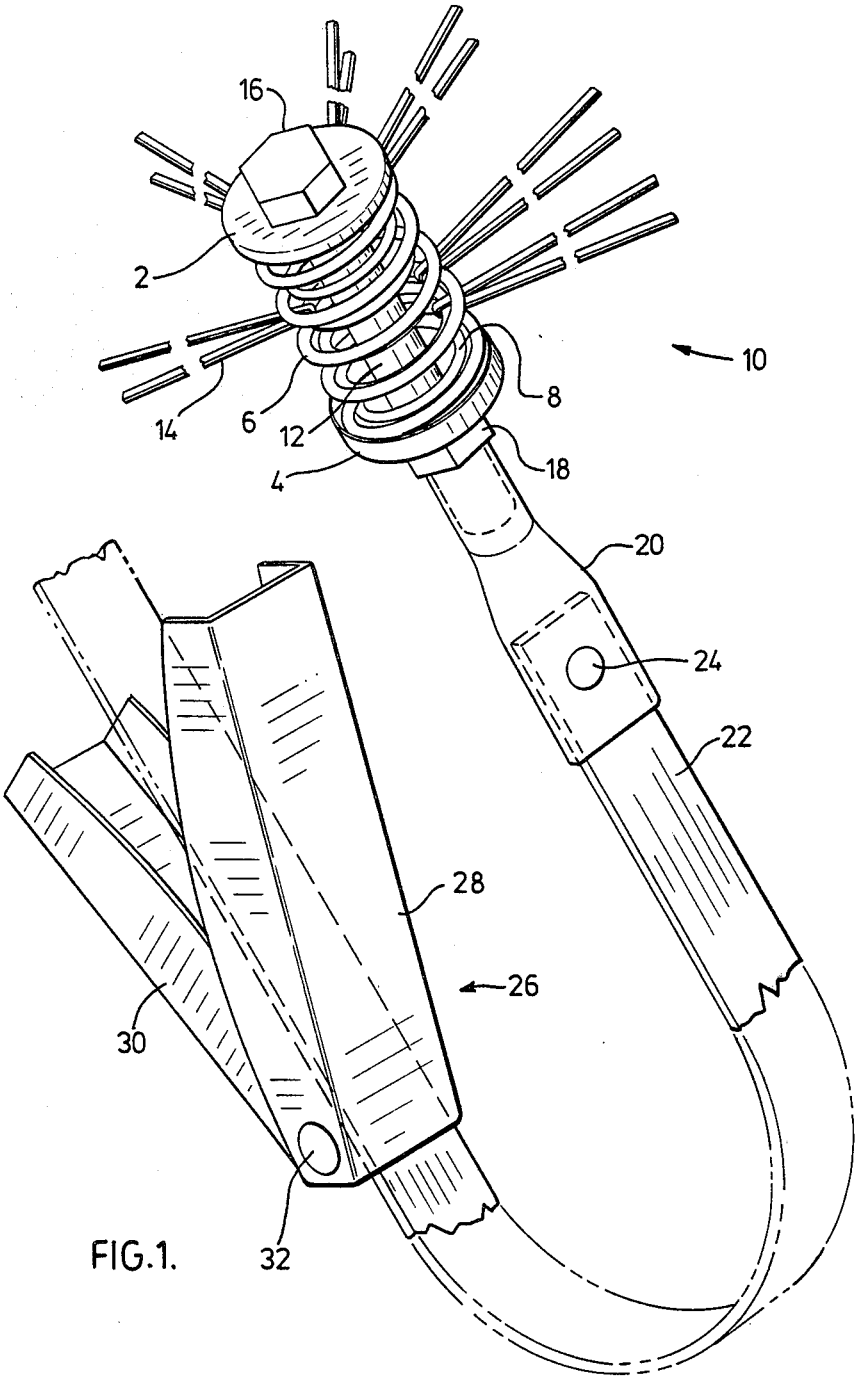
FIG. 1 is a general view showing the brush, the brush attachment means, the pushing means and the handle means in assembled relation.

FIG. 1 shows a brush assembly 10 mounted on brush attachment adaptor 20 secured to one end of a flexible steel pushing member 22 threaded through clamping handle means 26.

The brush assembly 10 has a central axial spindle 12 with bolt head 16 and threaded adjustable nut means 18. A pair of opposed end caps 2,4 contain an outer spiral spring 6 and an inner spiral spring 8 having a plurality of bifurcated tine members 14 engaging by the bight portion thereof the inner spring 8 and extending between adjacent coils of the outer spring 6.

The adaptor 20 is internally threaded to receive the threaded end of spindle 12, being secured as by a rivet 24 to the end of pushing member 22.

The clamping handle means 26 comprises a pair of opposed handle portions 28,30 having a pivotal connection by way of rivet 32 therebetween.

Figure 2:
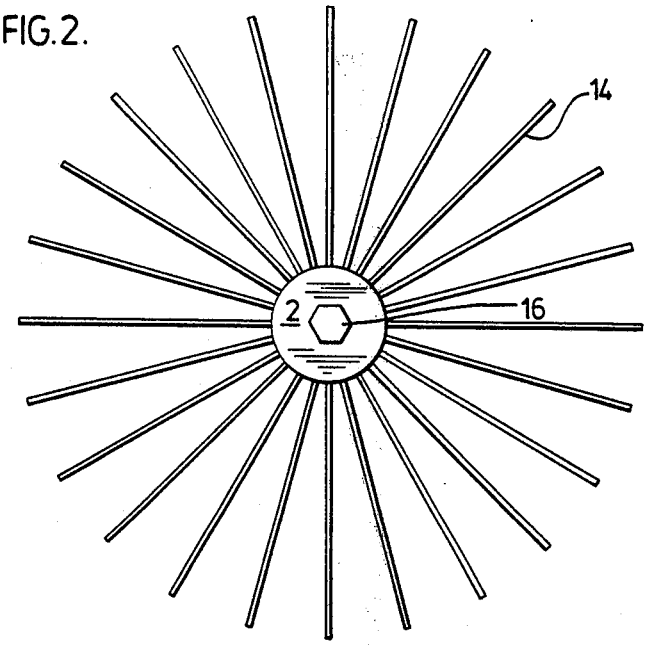
Figure 3:
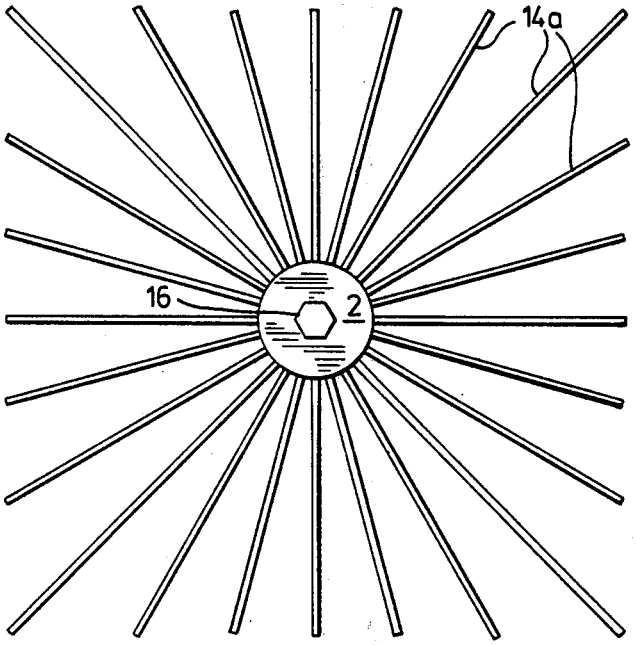
Figure 6:
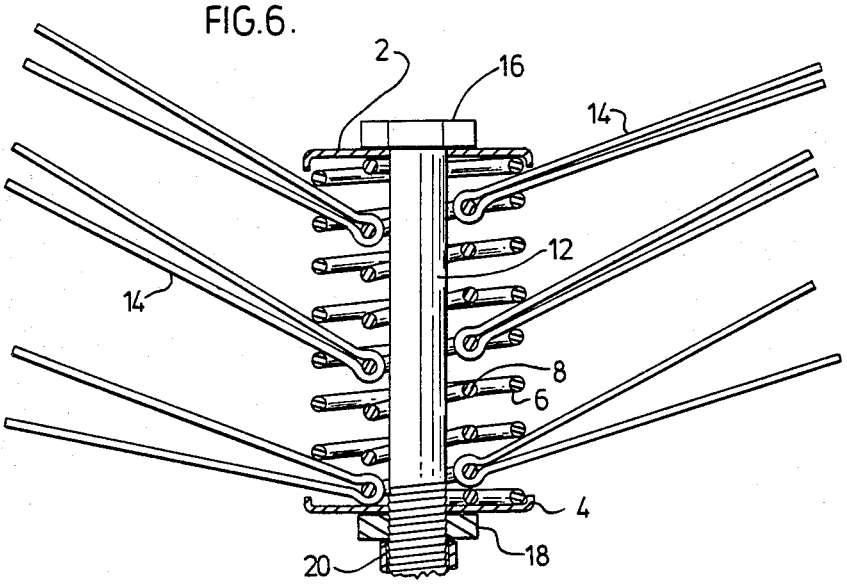
FIGS. 6 and 7 are views similar to FIG. 5, showing the brush in upward coning and downward coning relation.
Figure 7:
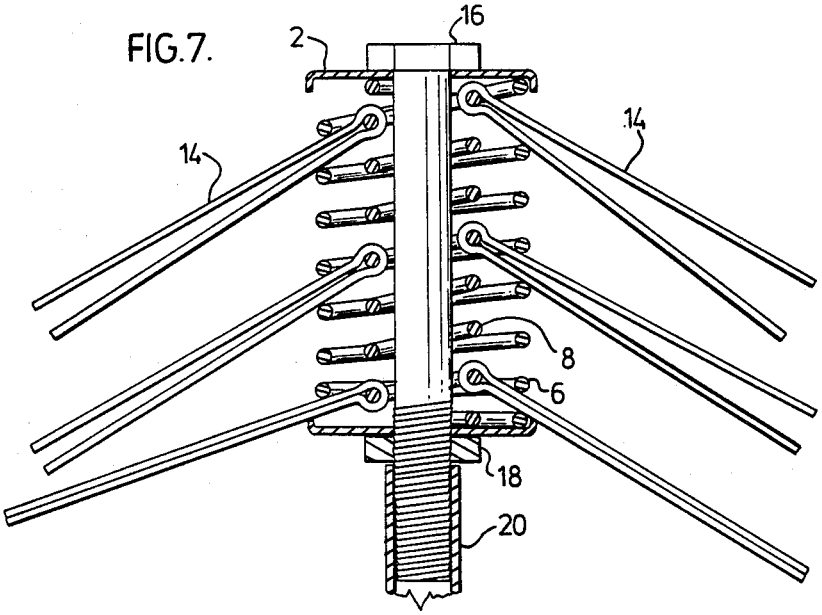

Turning to FIG. 2 it will be seen that the tine members 14 are of equal length, to provide a brush of circular planform. In the FIG. 3 embodiment and the FIG. 4 embodiment the respective tines **14*a*, 14*b*** are of non-uniform length, in order to provide respective square and rectangular planforms.

Referring to FIG. 5, the brush is shown in a fully open condition having the tines 14 substantially normally extended between the coils of the outer spring 6.

The springs 6 and 8 can be pre-loaded in compressed relation by adjustment of the nut 18, so as vary the effective rate of the two springs 6,8 thereby controlling the effective stiffness characteristic of the brush when being "coned" by passage in either direction past an obstruction.

Owing to the arrangement of the brush components, the application of force against the ends of some the tines 14 tends to produce corresponding deformation of adjacent tines 14 through the reactions obtained in the springs 6, 8. This has the effect of providing symetry to deformation of the brush 10, which in turn tends to promote self centering of the brush structure in undersized passages, and promotes passage past obstructions or corners, as shown also in FIGS. 10 and 11.

Figure 8:
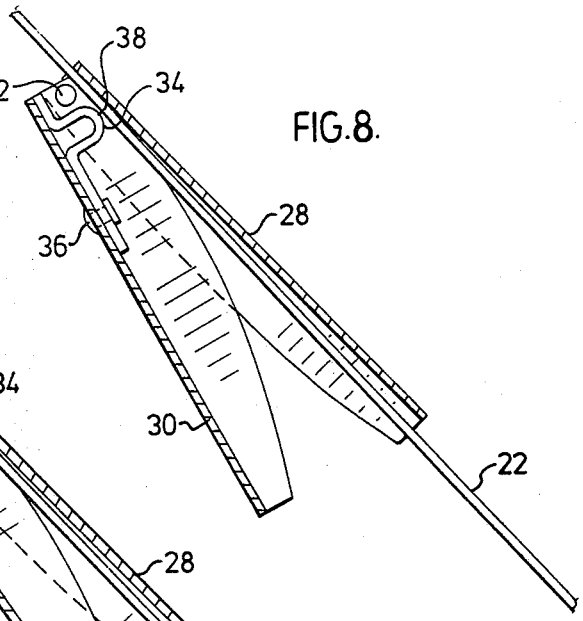
FIGS. 8 and 9 are longitudinal sections of the clamping handle means in respective non-gripping and gripping relation with the pushing means.
Figure 9:
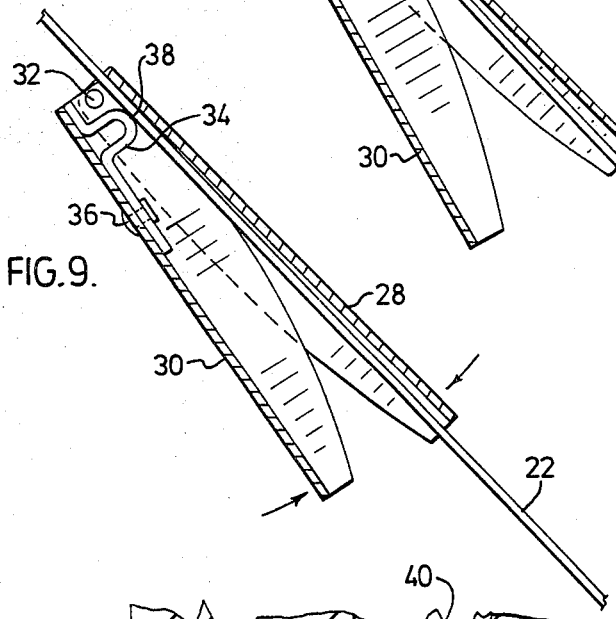

In FIGS. 8 and 9, the strap-like pushing member 22 is threaded through the handle means.

The handle portions 28,30 are pivoted about rivet member 32. The handle portion 30 has detent member 34 rivetted thereto at 36, having a U-shape, with the outer bight portion 38 making jamming contact with the member 22 when the handle portions 28,30 are squeezed manually in closing relation.

Figure 10:
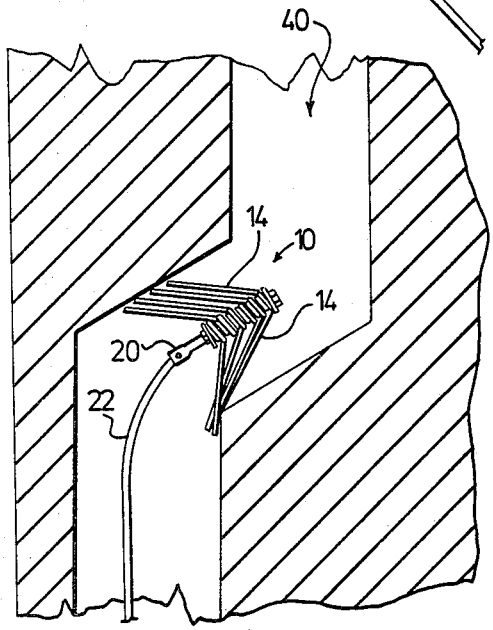
FIGS. 10 and 11 show the brush in deformed coning relation penetrating past obstructions in its path.
Figure 11:
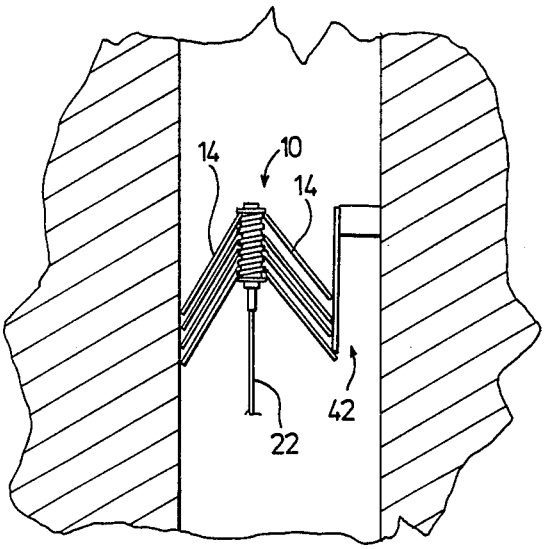

In the FIG. 10 and 11 arrangements the brush 10 is shown in central conical arrangement, relative to an angled chimney portion 40 or an open damper plate 42.

What I claim by letters patent of the United States is:

1. A chimney cleaning apparatus having a unitary pushing means, brush attachment means secured to one end thereof, and a tined brush of predetermined planform having a central spindle portion, an inner coil spring and an outer coil spring in mutual radially spaced relation mounted over the spindle portion, the coils of the inner spring being moveable axially within the coils of the outer spring, stiff wire tines each encircling the wire of the inner spring in pivotal relation therewith and extending between adjacent coil portions of the outer spring to permit elastic coning deformation of the brush for insertion of the brush past a restriction, in use, said unitary pushing means having sufficient length to traverse a chimney of predetermined length, and comprising an elastically deformable strap of rectangular section to permit elastic deformation of the strap to relatively short radiused bends, in the plane of the strap, and possessing sufficient stiffness to displace said brush upwardly along a chimney in surface cleaning relation therewith, said central spindle portion having a threaded end portion and threadedly adjustable nut means rotatably mounted thereon for axially pre-loading one said spring relative to the other said spring to apply a predetermined load in biasing relation with said tines to resist coning of the brush on passage thereof past an obstruction.

2. The apparatus as claimed in claim 1, said brush tines comprising a plurality of bifurcated tines in mutually spaced relation about said springs providing a brush of predetermined planform, said inner and outer springs connecting said tines in substantial synchronizing relation to promote coning of said tines under deforming forces to maintain said brush in substantial centered relation on passage thereof past an obstacle.

3. The apparatus as claimed in claim 2, said brush being of circular planform.

4. The apparatus as claimed in claim 2, said brush being of rectangular planform.

5. The apparatus as claimed in claim 2, said brush being of square planform.

6. The apparatus as claimed in claim 1, said central spindle portion having a pair of end caps thereon in opposing relation containing said coil springs therebetween, said nut means adjustably mounted on said spindle to move said end caps relative to each other in pre-compressing relation to said springs, to moderate the characteristics of said springs.

7. The apparatus as claimed in claim 1, wherein said tined brush is interchangeably secured to said brush attachment means.

* * * * *